US005565737A

United States Patent [19]

Keane

[11] Patent Number: 5,565,737

[45] Date of Patent: Oct. 15, 1996

[54] ALIASING SAMPLER FOR PLASMA PROBE DETECTION

[75] Inventor: Anthony R. A. Keane, Webster, N.Y.

[73] Assignee: ENI - a Division of Astec America, Inc., Rochester, N.Y.

[21] Appl. No.: 472,433

[22] Filed: Jun. 7, 1995

[51] Int. Cl.[6] ..... H05H 1/24

[52] U.S. Cl. ..... 315/111.21; 315/111.41; 315/111.51

[58] Field of Search ..... 315/111.21, 111.81, 315/111.31, 111.41, 111.51; 118/723 E; 156/345 P

[56] References Cited

U.S. PATENT DOCUMENTS 5,175,472 12/1992 Johnson et al. ..... 315/111.21

5,383,019 1/1995 Farrell et al. ..... 356/316

*Primary Examiner*—Robert Pascal
*Assistant Examiner*—David H. Vu
*Attorney, Agent, or Firm*—Trapani & Molldrem

[57] ABSTRACT

An aliasing sampler probe for detecting plasma RF voltage and current employs a sampling signal with a sampling rate slower that the RF fundamental frequency selected to produce an aliasing waveform at an aliasing frequency that is several orders of magnitude below the RF fundamental frequency. In one embodiment, the RF power is applied at 13.56 MHz. and sampling pulses have a sampling rate of 2.732 MHz to produce replicas of the RF voltage and current waveforms at an aliasing frequency of about 100 KHz. The aliasing replicas preserve phase and harmonic information with an accuracy that is not available from other sampling techniques.

8 Claims, 2 Drawing Sheets

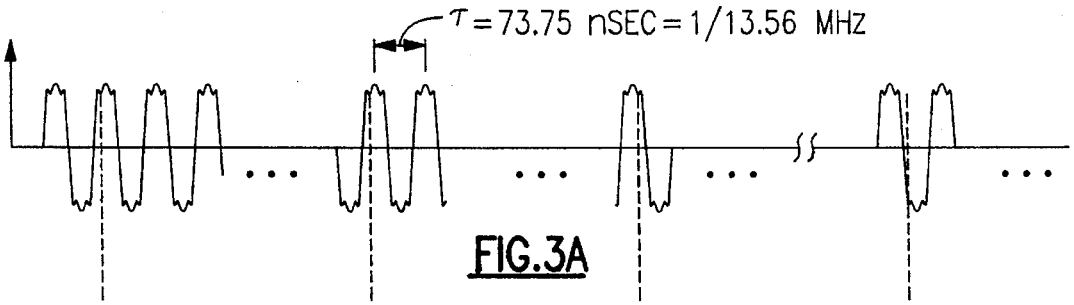
FIG.3A
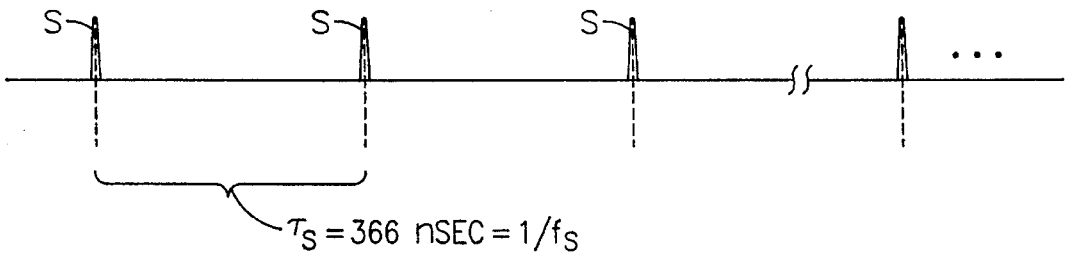
FIG.3B
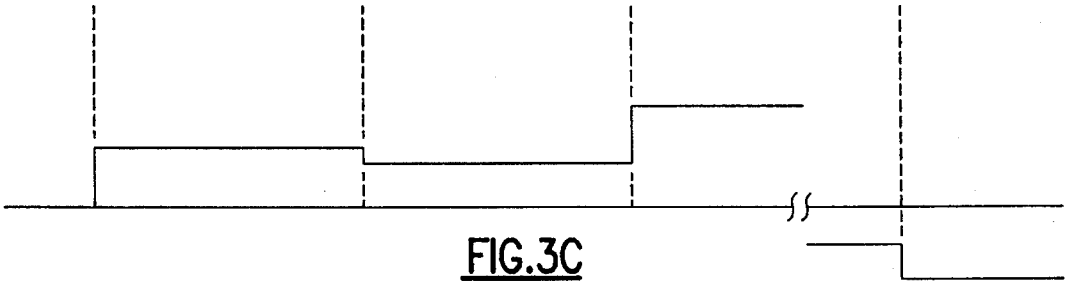
FIG.3C
FIG.4
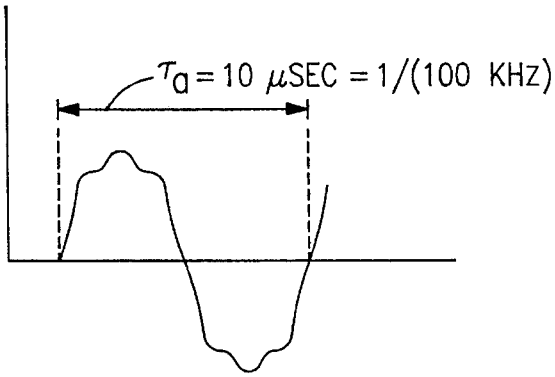

ALIASING SAMPLER FOR PLASMA PROBE DETECTION

BACKGROUND OF THE INVENTION

This invention relates to plasma generation equipment, and is particularly directed to probes for detecting the current and voltage of RF electrical power that is being supplied to an RF plasma chamber.

In a typical RF plasma generator arrangement, a high power RF source produces an RF wave at a preset frequency, i.e., 13.56 MHz, and this is furnished along a power conduit to a plasma chamber. Because there is typically a severe impedance mismatch between the RF power source and the plasma chamber, an impedance matching network is interposed between the two. There are non-linearities in the plasma chamber, and because of these and because of losses in the line and in the impedance matching network, the output of the RF generator does not all reach the plasma chamber. Therefore, it is conventional to employ a probe at the power input to the plasma chamber to detect the voltage and current of the RF wave as it enters the plasma chamber. By accurately measuring the voltage and current as close to the chamber as possible, the user of the plasma process can obtain a better indication of the quality of the plasma. This in turn yields better control of the etching characteristics for a silicon wafer or other workpiece in the chamber.

At the present time, diode probes are employed to detect the amplitude of the current and voltage waveforms. These probes simply employ the diodes to rectify the voltage and current waveforms, and deliver a simple DC metering output for voltage and for current. These probes have at least two drawbacks in this role. Diode detectors are inherently non-linear at low signal levels, and are notoriously subject to temperature drift. The diodes also are limited to detecting the signal peaks for the fundamental frequency only, and cannot yield any information about higher frequencies present in the RF power waveform. This means that for any harmonic information, it is impossible to obtain "harmonic fingerprints" and also that power measurement is not accurate when the waveform is rich in harmonics, as is usually the case in plasma work. In addition to this, it is impossible to obtain phase angle information between the current and voltage waveforms, which also renders the power measurement less accurate.

One proposal that has been considered to improve the detection of RF power has been to obtain digital samples of the voltage and current outputs of a probe, using flash conversion, and then to process the samples on a high-speed buffer RAM. However, this proposal does have problems with accuracy and precision. At the present time, flash conversion has a low dynamic range, being limited to about eight bits. To gain reasonable phase accuracy for plasma customer requirements, it is necessary to reach a precision of about twelve bits, so that a phase angle precision of better than one degree can be obtained at full power. In addition, flash converters require an extremely fast RAM in order to buffer a block of samples before they are processed in a digital signal processor (DSP), and the RAM circuitry is both space-consuming and expensive.

OBJECTS AND SUMMARY OF THE INVENTION

It is an object of this invention to provide a reliable but, low cost probe for detecting the current and voltage of RE power being applied to a plasma chamber and which avoids the drawbacks of the prior art.

It is a more specific object of this invention to provide an aliasing sampling scheme for detecting the RE current and voltage waveforms, and which preserves harmonic and phase information.

It is a another object to provide an aliasing sampling scheme that provides high accuracy of voltage, current, and phase, and is relatively insensitive to temperature drift.

It is a more particular object to provide an aliasing sampling arrangement which produces a reproduction of the applied RE current waveform and a reproduction of the applied RE voltage waveform, but at a much lower frequency, preserving phase and harmonic information of the actual applied waveform.

According to an aspect of the present invention, an aliasing sampling probe is used in connection with a plasma arrangement in which an RF power generator produces an RF electrical wave at a predetermined frequency, e.g., 13.56 MHz, and the electrical wave is applied through an impedance matching network to a power input of a plasma chamber. Inside the chamber, the RE electrical wave produces a plasma, which is used for etching, coating or depositing on a substrate such as a silicon wafer. The plasma process should be as predictable and repeatable as possible to assure consistent product quality. In order to do this, the process user needs to monitor the power characteristics continuously, and make adjustments or terminate the process according to the detected power measurements. Because of non-linearities in the plasma process, a number of harmonics can appear and can give valuable information about the plasma, if the harmonic information is available. Also, because a significant phase difference can appear between the voltage and current waveforms, the applied power is rarely the simple product of peak voltage and peak current.

To achieve this, an aliasing sampling circuit samples the amplitude of the RF voltage and the amplitude of the RF current at a predetermined sampling rate f, which is significantly lower than the predetermined RF fundamental frequency F of the applied RF power, e.g., 13.56 MHz. This produces a replica of the RF waveform, but at a lower aliasing frequency $f_a$, e.g., 100 KHz. The resulting aliasing waveform retains the harmonic information of the original waveform, and the relative phase between the voltage and current waveforms is preserved in the respective aliasing waveforms. It is possible to produce an accurate aliasing waveform because the drifting and change in the plasma characteristics is rather slow, and does not change significantly over several thousand cycles of the RF power wave.

The sampling frequency can be selected as $$f_s = F/N \pm f_a/N,$$

where N is an integer greater than unity. More specifically, where the highest harmonic of interest is the nth harmonic, e.g., the fifth harmonic of the applied RF power, then the integer N should be selected as equal to or higher than the harmonic number n. As aforesaid, the power fundamental frequency is normally 13.56 MHz. Typical aliasing frequencies could be between about 50 KHz and 250 KHz.

In a practical embodiment, the sampling circuit includes a sampling clock operated at the sampling rate $f_s$, and first and second sample and hold circuits operated by the sampling clock for sampling the voltage and the current of the RF power wave. The samples are digitized as twelve-bit words, and latched to digital inputs of a digital signal processor, or DSP. The voltage and current waveforms are sampled simultaneously, which permits the DSP to create simultaneous aliasing representations of the voltage and current waveforms. In one practical example, the aliasing sampler produces the replica waveforms at an aliasing frequency of 100 KHz, with an accuracy or precision sufficient to resolve the fifth harmonic and permit observation of phase angles within about one degree. The processed information can be sent to a host computer to control the plasma operation. Once the distal samples are stored in the DSP an algorithm such as a fast Fourier transform (FFT) can be run on the samples to produce a frequency-domain sample set, which can also be used to control the plasma operation, or employed for further analysis.

The above and many other objects, features, and advantages of this invention can be more fully appreciated from the ensuing description of a preferred embodiment, which should be read in conjunction with the accompanying Drawing.

BRIEF DESCRIPTION OF THE DRAWINGS

FIGS. 3A to 3C are charts showing the applied RF power waveform, sampling pulses, and sampled amplitude values, for explaining this embodiment.

FIG. 4 shows the aliasing waveform as produced by this embodiment.

DETAILED DESCRIPTION OF A PREFERRED EMBODIMENT

Figure 1:
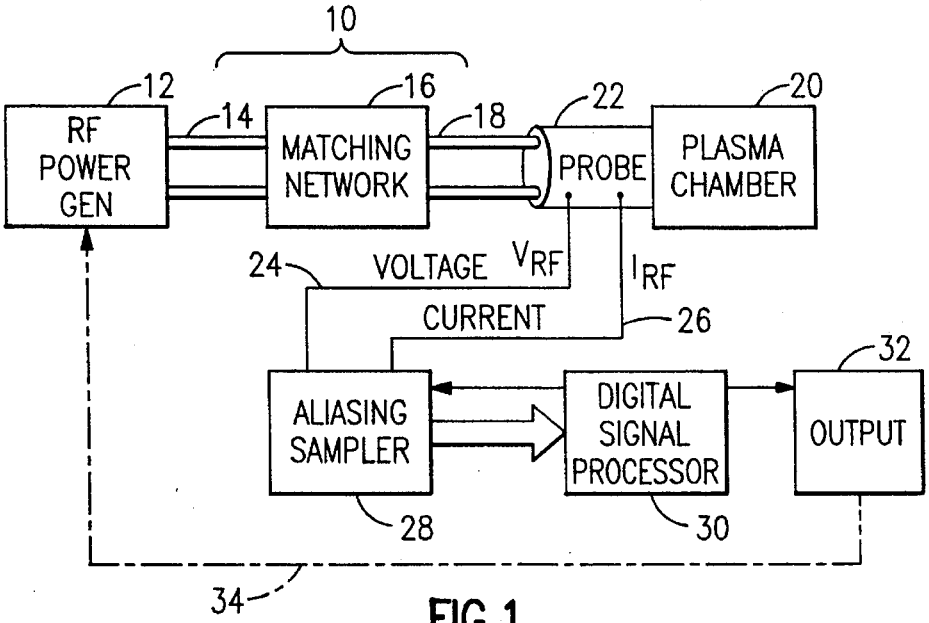
FIG. 1 is a block diagram of an RF plasma arrangement, showing an RF power generator, impedance match net, plasma chamber, and RF power probe, according to one preferred embodiment of this invention.

With reference to the Drawing, and initially to FIG. 1 thereof, a plasma process arrangement 10, e.g., for etching a silicon wafer or other workpiece, has an RF power generator, which produces RF power at a prescribed frequency, for example, 13.56 MHz at a predetermined power level, such as one kilowatt, and supplies RF power along a conduit 14 to a matching network 16. The output of the matching network 16 is coupled by a power conduit 18 to an input of a plasma chamber 20. A probe device 22, for sampling the voltage $V_{RF}$ and current $I_{RF}$ of the applied RF power is situated on the conduit 18 at the input to the chamber 20. Sampled voltage $V_{RF}$ and sampled current $I_{RF}$ are supplied along lines 24 and 26 to inputs of an aliasing sampler 28, which samples the voltage and current amplitudes at a sampling rate that is slightly slower or slightly faster than one sample for each whole number N of cycles of the RF power waveform. This produces a set of digital values that are supplied to a digital signal processor or DSP 30. The DSP processes the sample values, and provides an analysis of the current and voltage to an output means 32, which can be coupled via a feedback circuit 34 to control the RF power generator 12.

Figure 2:
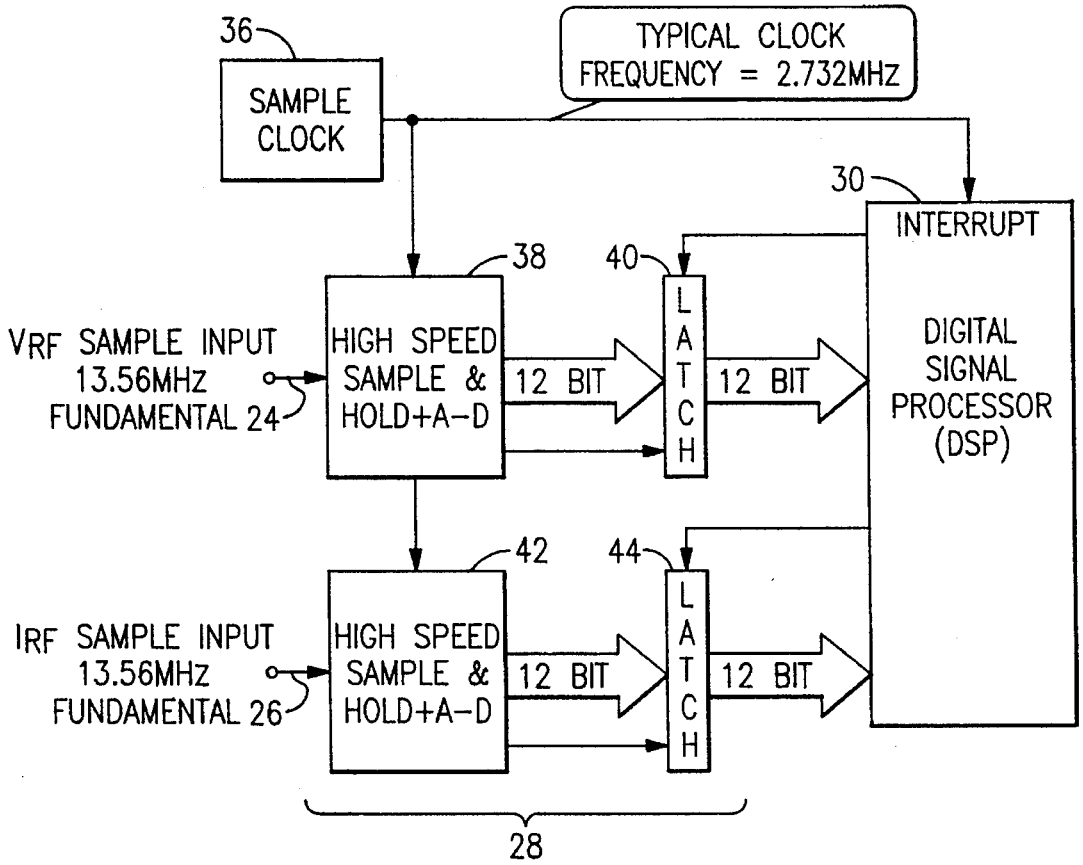
FIG. 2 is a simplified schematic diagram of the aliasing sampling portion of the probe of this embodiment.

Details of the aliasing sampler 28 are shown in the diagram of FIG. 2. Here a sample clock 36 supplies sampling pulses to a voltage sample and hold circuit 38 and current sample and hold circuit 42, and to an interrupt input of the DSP 30. The voltage sample $V_{RF}$ supplied along the line 24 and current sample $I_{RF}$ supplied along line 26 have a fundamental frequency of 13.56 MHz, but are not sinusoidal, and can be rather rich in harmonics, as illustrated by the waveform of FIG. 3A. The sample pulses S (FIG. 3B) occur at intervals of slightly greater than some predetermined whole number of cycles of the RF power wave. For example, the sample pulses can have an interval equal to ten complete cycles and an additional one-tenth cycle, or ten complete cycles less one-tenth cycle. In either event, the high-speed sample and hold circuit holds the amplitude level, as shown in FIG. 3C, and these successive sampled levels are synthesized to produce an aliasing waveform as shown in FIG. 4, having the same wave shape as the waveform of FIG. 3 A, but at a much lower frequency, e.g. one percent of the original frequency of 13.56 MHz.

Continuing with the description of FIG. 3, the sample and hold circuit 38 contains an analog-to-digital converter, or A-D, which converts the sampled values (FIG. 3C) to digital form, here with a resolution of at least 12 bits. The samples are provided over a 12-bit bus to a latch circuit 40, which latches the 12-bit samples to a data input of the DSP 30. The sample clock pulses 36 are also furnished to a second high-speed sample and hold circuit 42, also containing an analog-to-digital converter. This circuit 42 samples the amplitude of the RF current samples as supplied along the line 26 from the probe 22 The circuit provides a sequence of 12-bit samples to a latch 44 which furnishes the samples to a current data input of the DSP 30.

In one practical example, the sample clock 36 is operated at a sampling frequency $f_s$ of 2.732 MHz. This produces the aliasing waveform at a fundamental frequency $f_a$ of 100 KHz. The RF samples enter the two sample and hold circuits 38, 42 which synchronously sample the voltage $V_{RF}$ and current $I_{RF}$ waveforms to produce the aliasing waveforms (FIG. 4) at 100 KHz. To do this the 13.56 MHz waveform is sampled at an integer fraction (1/N) of 13,600 KHz plus (or minus) 100 KHz, that is $$f_s=13{,}560{,}000/N\pm100{,}000/N$$

If the operator's goal is to obtain reliable information about the fifth harmonic, then a frequency of 500 KHz has to be available in the aliasing waveform. To do this we select N=5, and we obtain a sampling frequency $$f_s=13{,}560{,}000/5+100{,}000/5=2.732\text{ MHz.}$$

The actual sampling frequency should be selected depending on the resolution desired. In this case, the harmonic frequency of 500 KHz fits comfortably within the sampling theorem limit of 2.732/2 MHz of this example. As shown in FIG. 3B, the sampling signal S has a period $T_s=1/f_s$ of about 366 nsec, and a pulse width on the order of 1 to 5 nsec. The RF power wave has a period T of $1/13.56$ MHz or 73.75 nsec (FIG. 3A).

In this embodiment the DSP 30 can typically use a high speed interrupt routine to take in a block of samples at the 2.732 MHz sample rate for fast Fourier transform (FFT) or other processing. When the samples have been stored in the memory of the DSP 30, an algorithm such as an FFT can be run on the sample block in order to produce a frequency-domain sample set. The processed information is then sent to a host computer (not shown) for further analysis, or for control purposes to obtain maximum product quality from the plasma process.

While this invention has now been described with reference to a single preferred embodiment, it should be understood that the invention is not limited to the described embodiment. Rather, many modifications and variations would present themselves to persons skilled in the art without departure from the scope and spirit of the invention, as defined in the appended claims.

I claim:

1. In a plasma arrangement in which an RF power generator produces an RF electrical wave at a predetermined RF frequency and containing harmonic information which affects the form of the RF wave, said electrical wave being supplied through an RF matching network to a power input of a plasma chamber within which said electrical wave produces a plasma, and in which detection means samples the RF electrical wave at the input to said plasma chamber to determine a measurement of the RF electrical power applied to said plasma chamber;

the improvement wherein said detection means includes sampling means for sampling the amplitude of said RF wave at a predetermined sampling rate lower than said predetermined RF frequency, and means for synthesizing the sampled amplitude to produce an aliasing waveform at a predetermined aliasing frequency significantly lower than said predetermined RF frequency, in which said aliasing waveform preserves the harmonic information of said RF wave.

2. In a plasma arrangement in which an RF power generator produces an RF electrical wave at a predetermined RF frequency, said electrical wave being supplied through an RF matching network to a power input of a plasma chamber within which said electrical wave produces a plasma, and in which detection means samples the RF electrical wave at the input to said plasma chamber to determine a measurement of the RF electrical power applied to said plasma chamber;

the improvement wherein said detection means includes sampling means for sampling the amplitude of said RF wave at a predetermined sampling rate lower than said predetermined RF frequency, and means for synthesizing the sampled amplitude to produce an aliasing waveform at a predetermined aliasing frequency significantly lower than said predetermined RF frequency; wherein said RF power generator produces said RF electrical wave at said predetermined RF frequency F, said predetermining aliasing frequency is selected at $f_a$, and said sampling rate $f_s$ is selected as $$f_s=F/N\pm f_a/N$$

where N is a whole integer greater than one.

3. The improvement of claim 2, wherein said predetermined frequency F is 13.56 MHz, said aliasing frequency $f_a$ is on the order of 50 KHz to 250 KHz.

4. The improvement of claim 2, wherein said integer N is at least five.

5. In a plasma arrangement in which an RF power generator produces an RF electrical wave at a predetermined RF frequency, said electrical wave being supplied through an RF matching network to a power input of a plasma chamber within which said electrical wave produces a plasma, and in which detection means samples the RF electrical wave at the input to said plasma chamber to determine a measurement of the RF electrical power applied to said plasma chamber;

the improvement wherein said detection means includes sampling means for sampling the amplitude of said RF wave at a predetermined sampling rate lower than said predetermined RF frequency, and means for synthesizing the sampled amplitude to produce an aliasing waveform at a predetermined aliasing frequency significantly lower than said predetermined RF frequency; wherein said sampling means includes a sampling clock operating at said sampling rate, a first high speed sample and hold means operated by said sampling clock for sampling the voltage of said RF wave, a second high speed sample and hold means operated by said sampling clock for sampling the current of said RF wave, and said means for synthesizing includes means for generating an aliasing voltage waveform and for generating an aliasing current waveform.

6. The improvement of claim 5, wherein said first and second sample and hold means each include an A/D converter producing a digital sample with a width of at least 12 bits.

7. The improvement of claim 6, wherein said first and second sample and hold means sample the associated voltage and current waveforms simultaneously.

8. The improvement of claim 6, wherein said sampling means includes first and second digital latches respectively coupled between said first and said second sample and hold means and respective inputs to a digital signal processor.

* * * * *